US006102143A

United States Patent [19]

Snyder et al.

[11] Patent Number: 6,102,143

[45] Date of Patent: Aug. 15, 2000

[54] SHAPED POLYCRYSTALLINE CUTTER ELEMENTS

[75] Inventors: Shelly R. Snyder, Columbus; George E. Bailey, Dublin; Eoin O'Tighearnaigh, Columbus, all of Ohio

[73] Assignee: General Electric Company, Pittsfield, Mass.

[21] Appl. No.: 09/072,471

[22] Filed: May 4, 1998

[51] Int. Cl.[7] ..... E21B 10/46

[52] U.S. Cl. ..... 175/432; 76/108.2

[58] Field of Search ..... 175/432, 434, 175/430, 431; 76/108.2

[56] References Cited

U.S. PATENT DOCUMENTS

| | | | |
|---|---|---|---|
| 3,136,615 | 6/1964 | Bovenkerk et al. . | |
| 3,141,746 | 7/1964 | De Lai . | |
| 3,233,988 | 2/1966 | Wentorf, Jr. et al. . | |
| 3,743,489 | 7/1973 | Wentorf, Jr. et al. . | |
| 3,745,623 | 7/1973 | Wentorf, Jr. et al. . | |
| 3,767,371 | 10/1973 | Wentorf, Jr. et al. . | |
| 4,109,737 | 8/1978 | Bovenkerk . | |
| 5,355,969 | 10/1994 | Hardy et al. | 175/432 |
| 5,374,854 | 12/1994 | Chen | 307/117 |
| 5,379,854 | 1/1995 | Dennis | 175/434 |
| 5,469,927 | 11/1995 | Griffin | 175/432 |
| 5,544,713 | 8/1996 | Dennis | 175/434 |
| 5,564,511 | 10/1996 | Frushour | 175/431 |
| 5,598,750 | 2/1997 | Griffin et al. | 76/108.2 |
| 5,711,702 | 1/1998 | Devlin | 451/540 |
| 5,816,347 | 10/1998 | Dennis et al. | 175/432 |
| 5,829,541 | 11/1998 | Flood et al. | 175/426 |
| 5,862,873 | 1/1999 | Matthias et al. | 175/432 |
| 5,871,060 | 2/1999 | Jensen et al. | 175/420.2 |
| 5,906,246 | 5/1999 | Mensa-Wilmot et al. | 175/432 |

*Primary Examiner*—Hoang Dang

[57] ABSTRACT

A cutting element is composed of a metal carbide stud having an outer hemispherical distal end which has a series of annular ridges. The tops of the annual ridges are substantially non-planar, i.e., curvilinear, such that the angle formed between the slope on either side is less than 120°. There are no surfaces tangent to vertical on such ridges. A layer of polycrystalline superabrasive material is disposed over the annular ridges. This cutter is easily manufacturable as the metal stud can be pressed and extracted from the punch without further machining and the surface geometry of the metal stud allows for complete PCD compaction during diamond sintering.

19 Claims, 1 Drawing Sheet

SHAPED POLYCRYSTALLINE CUTTER ELEMENTS

CROSS-REFERENCE TO RELATED APPLICATIONS

None

STATEMENT REGARDING FEDERALLY SPONSORED RESEARCH

Not applicable.

BACKGROUND OF THE INVENTION

The present invention relates generally to polycrystalline cutter elements and more particularly to stud-mounted polycrystalline cutter elements with an improved stud-polycrystalline interface.

An abrasive particle compact is a polycrystalline mass of abrasive particles, such as diamond and/or cubic boron nitride, bonded together to form an integral, tough, high-strength mass. Such components can be bonded together in a particle-to-particle self-bonded relationship, by means of a bonding medium disposed between the particles, or by combinations thereof. For example, see U.S. Pat. Nos. 3,136,615, 3,141,746, and 3,233,988. A supported abrasive particle compact, herein termed a composite compact, is an abrasive particle compact which is bonded to a substrate material, such as cemented tungsten carbide. Compacts of this type are described, for example, in U.S. Pat. Nos. 3,743,489, 3,745,623, and 3,767,371. The bond to the support can be formed either during or subsequent to the formation of the abrasive particle compact.

Composite compacts have found special utility as cutting elements in drill bits. Drill bits for use in rock drilling, machining of wear resistant materials, and other operations which require high abrasion resistance or wear resistance generally consist of a plurality of polycrystalline abrasive cutting elements fixed in a holder. Particularly, U.S. Pat. Nos. 4,109,737 and 5,379,854, describe drill bits with a tungsten carbide stud (substrate) having a polycrystalline diamond compact on the outer surface of the cutting element. A plurality of these cutting elements then are mounted generally by interference fit into recesses into the crown of a drill bit, such as a rotary drill bit. These drill bits generally have means for providing water cooling or other cooling fluids to the interface between the drill crown and the substance being drilled during drilling operations. Generally, the cutting element comprises an elongated pin of a metal carbide (stud) which may be either sintered or cemented carbide (such as tungsten carbide) with an abrasive particle compact (e.g., polycrystalline diamond) at one end of the pin for form a composite compact.

Polycrystalline diamond (PCD) is used routinely as an abrasive wear and impact resistant surface in drilling, mining, or woodworking applications. The PCD typically is bonded to a metal stud which frequently exhibits ridges, circles, or other undulating features on the surface bonded to the PCD. These interfacial designs are an attempt to improve the adhesion of the PCD to the metal stud. Common failure modes of cutters are abrasive wear of the PCD; impact damage of the PCD caused by loads either parallel or perpendicular to the PCD carbide interface, i.e., percussion or shear damage, slowly propagating fatigue fractures either in the PCD or metal stud or at their interface, and thermal fractures.

Prior proposals aimed at improving the metal carbide stud-polycrystalline abrasive interface include U.S. Pat. No. 5,379,854 which proposes a cutter element whose end bears a plurality of ridges wherein each ridge has substantially planar top surface. U.S. Pat. No. 5,711,702 provides a carbide stud having a series of annual grooves of varying depth and to which a polycrystalline abrasive layer is attached. U.S. Pat. No. 5,355,969 provides a cylindrical composite compact where the interface is formed from a series of undulations. While these designs do provide increased surface area between the carbide stud and the polycrystalline abrasive cap, manufacturing of such studs often requires machining in the early stages of manufacturing and planar groove tops often leads to non-uniform or incomplete abrasive compacting between the ridges.

BRIEF SUMMARY OF THE INVENTION

The present invention avoids the use of planar ridges at the carbide/polycrystalline abrasive cap interface and utilizes an interface which is much easier to fabricate. The inventive cutting element, then, is composed of a metal carbide stud having a generally outer hemispherical distal end which has a series of annular ridges. The tops of the annual ridges are substantially non-planar, i.e., curvilinear, such that the angle formed between the slope on either side is less than 120°. There are no surfaces tangent to vertical on such ridges. A layer of polycrystalline superabrasive material is disposed over the annular ridges. Optionally, one or more of the ridges can be undulating in configuration. Also, the metal carbide stud can be chamfered or radiused at the stud-PCD interface.

Advantages of the present invention include a cutter which displays improved cutter life by maximizing the interfacial adhesion between the PCD layer and the metal stud. Another advantage is that the ridges at the interface may inhibit fracture propagation. A further advantage is a cutter which is easily manufacturable as the metal stud can be pressed and extracted from the punch without further machining and the surface geometry of the metal stud allows for complete PCD compaction during diamond sintering. These and other advantages will be readily apparent to those skilled in this art.

BRIEF DESCRIPTION OF THE DRAWINGS

For a fuller understanding of the nature and objects of the present invention, reference should be had to the following detailed description taken in connection with the accompanying drawings in which.

The drawings will be described in detail below.

DETAILED DESCRIPTION OF THE INVENTION

The present invention describes a new polycrystalline abrasive domed cutter of longer life and durability. The polycrystalline dome layer preferably is polycrystalline diamond (PCD) and PCD cutters will be described with particularity herein. However, other materials that are included within the scope of this invention are synthetic and natural diamond, cubic boron nitride (CBN), wurtzite boron nitride, combinations thereof, and like materials. Polycrystalline diamond is the preferred polycrystalline layer. Domed cutters include, inter alia, hemispherical, conical, ballistic, and other domed-type or reduced hemispherical cutters.

The hemispherical end cap is formed of PCD or other polycrystalline abrasive material which is attached to a metal stud whose composition is largely a metal carbide former, such as, for example, a cemented metal carbide. The cemented metal carbide substrate is conventional in composition and, thus, may be include any of the Group IVB, VB, or VIB metals, which are pressed and sintered in the presence of a binder of cobalt, nickel or iron, or alloys thereof. The preferred metal carbide is tungsten carbide. In general, all forms of tungsten carbide inserts used in the drilling industry may be enhanced by the addition of a diamond layer, and further improved by the current invention through the use of the novel interfacial design disclosed herein.

The novel interfacial design is calculated to increase the life of the PCD cutter by modification of the geometry between the PCD/carbide stud interface. Such geometry modification results in a reduction of residual stresses in the diamond and carbide layers, relative to a planar interface, as well as an increase in adhesion between these layers. Additionally, the geometry of the cutter interface allows for easy fabrication of the stud and complete compaction of the diamond powder in the shoulders of the stud.

Figure 1:
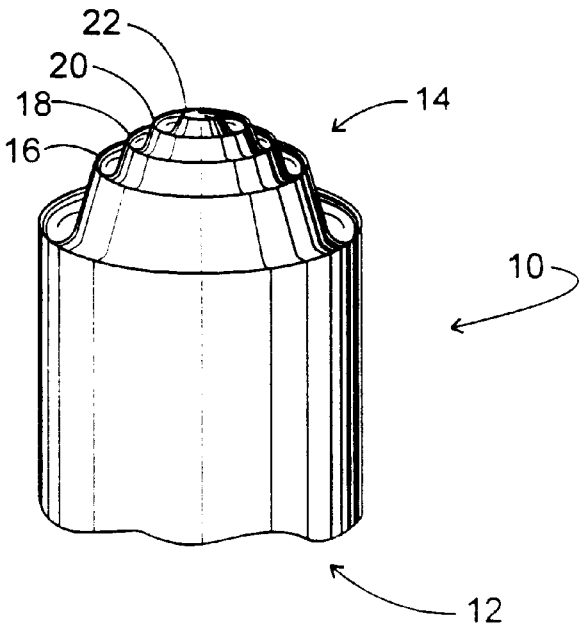
FIG. 1 is a perspective view of the metal carbide stud of novel cutting element of the present invention.

Referring to FIG. 1, carbide stud 10 is shown before attachment of any PCD or other polycrystalline abrasive layer. Proximal end 12 is adapted to be placed in a drill bit in conventional fashion. Distal end 14 is hemispherical in cross-sectional profile Proximal end 12 of carbide stud 10 has a series of ridges 16, 18, 20, and 22; although, the number of ridges can be lesser or greater than the number shown in the drawings. Of importance, however, is that the ridges have a generally hemispherical cross-sectional configuration and the precise shape of the ridges. That is, ridges 16–20 are annular in shape. Additionally, the tops of ridges 16–20 are substantially non-planar (i.e., the ridges are curvilinear in shape) such that the angle formed between the slope on either side is less than 120°. Finally, there are no surfaces tangent to vertical on ridges 16–20. Thus, ridges 16–20 have no vertical or horizontal surfaces. Each ridge can be the same in dimension as each adjacent ridge or they can vary in height and width, as well as in shape. Thus, the manufacturer is given flexibility in the design of the inventive cutter elements.

Figure 2:
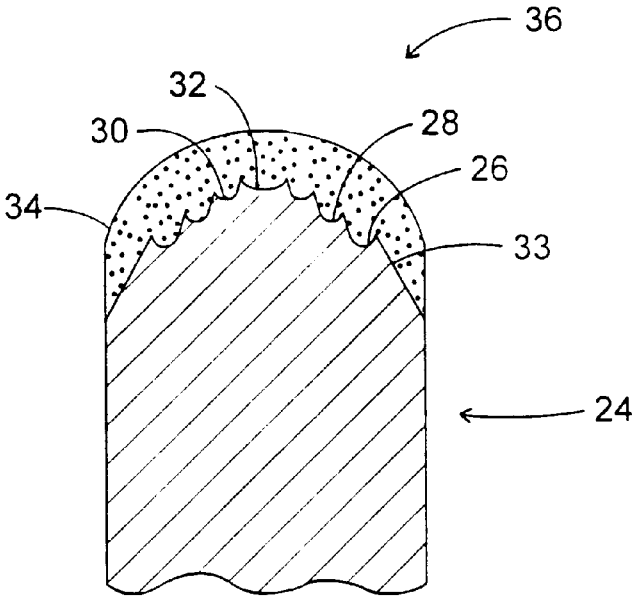
FIG. 2 is a cross-sectional elevational view of another cutting element with the abrasive layer like that shown in FIG. 1.

FIG. 2 shows carbide stud 24 which is like stud 10 in FIG. 1, except that ridges 26, 28, 20, and 32 have an undulating configuration and chamfer 33 has been provided. PCD layer 34 in FIG. 2 illustrates the carbide-PCD interface which translates into thickness differentials of PCD layer 34 by dint of ridges 26–32. Inhibition of fracture propagation in PCD layer 34 is an expected benefit of such a design.

Fabrication of the novel cutter element also is enhanced by virtue of the interface configuration illustrated in the drawings. That is, studs 12 and 24 can be pressed and extracted from the punch without further machining due to the non-planar construction of the carbide ridges. Moreover, complete compaction of PCD layer 34 would be expected also by dint of such curvilinear ridge configuration. Finishing operations are expected to include surface grinding or lapping, and an OD (outside diameter) grind of primarily metal carbide until PCD layer 34 has been exposed at distal end 14.

Now, the outer surface of PCD layer 34 can be hemispherical, conical, ballistic, cylindrical, chisel, domed, or other hemispherical shapes, with optional flat planes which may or may not correspond with the ridges of carbide stud 24. The manufacturer has flexibility in fabrication of the PCD layer 34 while retaining expected fabrication and use benefits.

The type of polycrystalline material, grain size and distribution, crystal shape, and like factors also can vary widely within the discretion of the manufacturer. Such is the flexibility of the present invention. The same is true with respect to the composition of the metal stud.

While the invention has been described and illustrated in connection with certain preferred embodiments thereof, it will be apparent to those skilled in the art that the invention is not limited thereto. All references cited herein are expressly incorporated herein by reference.

We claim:

1. A cutter element, which comprises:

(a) a metal carbide stud having an outer generally hemispherical distal end and a proximal end adapted to be placed into a drill bit, said hemispherical distal end has a series of annular ridges the tops of which are substantially non-planar such that the angle formed between the slope on either side is less than 120° and there are no surfaces tangent to vertical on such ridges; and (b) a layer of polycrystalline abrasive material disposed over said distal end having said annular ridges, wherein each successive ridge from the outermost to the innermost being higher so as to retain a hemispherical cross-sectional profile.

2. The cutter element of claim 1, wherein said metal carbides stud is selected from the group consisting essentially of Group IVB, Group VB, and Group VIB metal carbides, and the polycrystalline abrasive material is selected from the group consisting essentially of diamond, cubic boron nitride, wurtzite boron nitride, and combinations thereof.

3. The cutter element of claim 2, wherein said polycrystalline abrasive material is polycrystalline diamond.

4. The cutter element of claim 3, wherein said metal carbide is tungsten carbide.

5. The cutter element of claim 4, wherein said polycrystalline abrasive material is polycrystalline diamond.

6. The cutter element of claim 1, wherein said metal carbide stud is cylindrical.

7. The cutter element of claim 1, wherein at least one of said annular ridges is undulating.

8. The cutter element of claim 7, wherein all of said annular ridges are undulating.

9. The cutter element of claim 1, wherein the proximal end of said metal carbide stud is chamfered or radiused.

10. The cutter element of claim 1, wherein said layer of polycrystalline material is hemispherical, conical, ballistic, cylindrical, chisel, or domed shaped.

11. A method for making a cutter element, which comprises:

(a) forming a metal carbide stud having an outer generally hemispherical distal end and a proximal end adapted to be placed into a drill bit to have a series of annular ridges on its hemispherical distal end, wherein said ridges have tops which are substantially non-planar such that the angle formed between the slope on either side is less than 120° and there are no surfaces tangent to vertical on such ridges; and (b) disposing a layer of polycrystalline abrasive material over said distal end having said annular ridges, wherein each successive ridge from the outermost to the innermost being higher so as to retain a hemispherical cross-sectional profile.

12. The cutter element of claim 11, wherein said metal carbides stud is selected from the group consisting essentially of Group IVB, Group VB, and Group VIB metal carbides, and the polycrystalline abrasive material is selected from the group consisting essentially of diamond, cubic boron nitride, wurtzite boron nitride, and combinations thereof.

13. The cutter element of claim 12, wherein said polycrystalline abrasive material is polycrystalline diamond.

14. The cutter element of claim 13, wherein said metal carbide is tungsten carbide.

15. The cutter element of claim 14, wherein said polycrystalline abrasive material is polycrystalline diamond.

16. The cutter element of claim 11, wherein said metal carbide stud is cylindrical.

17. The cutter element of claim 11, wherein at least one of said annular ridges is undulating.

18. The cutter element of claim 17, wherein all of said annular ridges are undulating.

19. The cutter element of claim 11, wherein the proximal end of said metal carbide stud is chamfered or radiused.

* * * * *